US008024878B2

(12) United States Patent
Meijer et al.

(10) Patent No.: US 8,024,878 B2
(45) Date of Patent: Sep. 27, 2011

(54) BANNER STAND

(75) Inventors: Ulf Meijer, Norrköping (SE); Björn Ake Sköld, Norrköping (SE)

(73) Assignee: Expand International AB, Johanneshov (SE)

( * ) Notice: Subject to any disclaimer, the term of this patent is extended or adjusted under 35 U.S.C. 154(b) by 580 days.

(21) Appl. No.: 11/883,756

(22) PCT Filed: Feb. 7, 2006

(86) PCT No.: PCT/SE2006/000180

§ 371 (c)(1),
(2), (4) Date: Apr. 9, 2008

(87) PCT Pub. No.: WO2006/083226

PCT Pub. Date: Aug. 10, 2006

(65) Prior Publication Data

US 2009/0019739 A1 Jan. 22, 2009

(30) Foreign Application Priority Data

Feb. 7, 2005 (SE) ..... 0500300
Feb. 17, 2005 (SE) ..... 0500430

(51) Int. Cl.
*G09F 11/18* (2006.01)

(52) U.S. Cl. ..... 40/514; 40/517

(58) Field of Classification Search ..... 40/514–517; 242/371, 373, 375.3

See application file for complete search history.

(56) References Cited

U.S. PATENT DOCUMENTS

| | | | | |
|---|---|---|---|---|
| 3,448,943 | A | 6/1969 | Herou | |
| 4,345,636 | A | 8/1982 | Fukuchi | |
| 7,559,163 | B2 * | 7/2009 | Ofuji et al. | 40/514 |
| 2004/0020603 | A1 | 2/2004 | Johansson et al. | |
| 2006/0107566 | A1 * | 5/2006 | Van Rens | 40/515 |

FOREIGN PATENT DOCUMENTS

| | | |
|---|---|---|
| EP | 0 105 449 | 4/1884 |
| FR | 2 821 965 | 9/2002 |
| JP | 2002-371777 | 12/2002 |

* cited by examiner

*Primary Examiner* — Casandra Davis
(74) *Attorney, Agent, or Firm* — Drinker Biddle & Reath LLP

(57) ABSTRACT

Stand for banners and the like including a foot part, taking up a cylinder on which a banner can be rolled up on and drawn out from and a device for achieving a rolling up movement for the rolling up of the banner. The rolling up device includes a driving device coupled to the cylinder for rolling up the banner, the driving device comprising a rubber string which at the pulling out of the banner is would up on a drum that is conical and with the string fastened in the wider end so that at a rolled up banner the string runs out from the wider end of the conical drive rollers so that the torque that is achieved by the string is sufficient for the rolling up of the banner's complete rolling up in spite of the rubber string in this position having its minimum tension force.

9 Claims, 1 Drawing Sheet

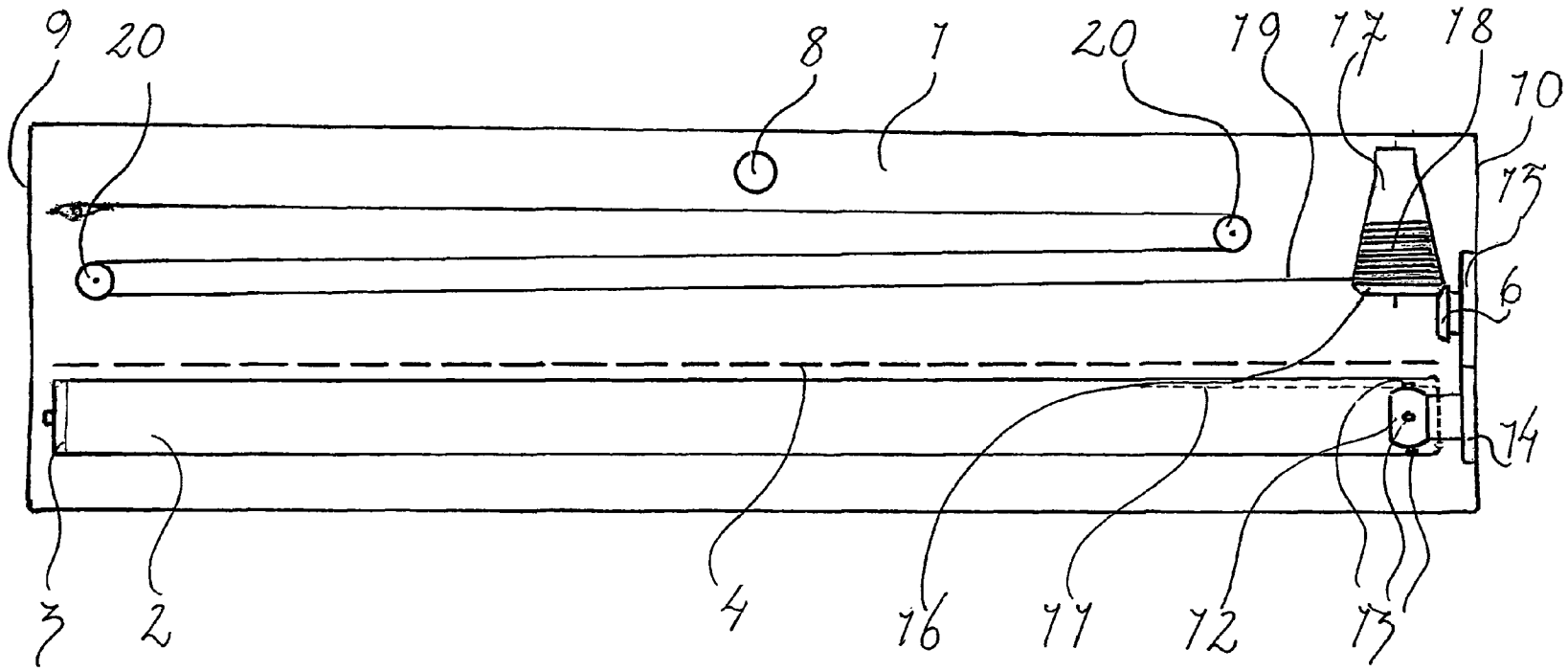
10
18
17
19
20
1
8
9
20
15
6
14
13
12
11
16
4
2
3

BANNER STAND

CROSS-REFERENCE TO RELATED APPLICATIONS

This application is the U.S. national phase of the International Patent Application No. PCT/SE2006/000180 filed Feb. 7, 2006, which claims the benefit of Swedish Application No. 0500300-9, filed Feb. 7, 2005, and Swedish Application No. 0500430-4, filed Feb. 17, 2005.

BACKGROUND OF THE INVENTION

Stand for banners and the like, including a foot part, comprising a cylinder on which the banner can be rolled up on or be rolled off from respectively, and a device for the driving of an up-rolling movement rolling up the banner. Banner stands of this kind are in particular used at exhibitions and the like since they are quick and easy to put up and take down. In order to hold up the banner this is in the upper end fastened in a strip that in turn is held up by a demountable pole that is fastened in the foot part.

Even if these banner stands facilitate the mounting and demounting of more or less temporary put up banners they still have drawbacks. One such, drawback is the frequently insufficient rolling up of the upper end of the banner at demounting. An other drawback is the exchange of banner, which frequently is circumstantial. In particular it has shown itself difficult to solve both these problems in one and the same device.

BRIEF SUMMARY OF THE INVENTION

The object of the invention is to come to terms with the above problems so that a more efficient banner stand is obtained, that is more easily handled.

BRIEF DESCRIPTION OF THE SEVERAL VIEWS OF THE DRAWING(S)

The FIGURE is a schematic view of a banner stand in accordance with an embodiment of the present invention.

DETAILED DESCRIPTION OF THE INVENTION

Further advantages and characteristics of the invention are apparent from the following description of an embodiment shown in the enclosed drawing. The banner stand depicted in the drawing includes a foot part 1 in which the banner 2 is arranged on a cylinder 3. Behind a slot 4 for the pulling out of the banner a mounting hole 8 is arranged for a pole, not shown, that in its upper end can hold up an in the upper end of the banner clamped strip.

The cylinder 3 on which the banner is rolled is journaled rotatable in the ends 9 and 10 of the foot part 1. The banner is in the present case taped on the cylinder 3, but one can also consider it fastened in some other way.

In one end of the cylinder 3 a winding mechanism is arranged in mesh with the cylinder. For this the banner cylinder 3 on the inside is provided with grooves 11 that at mounting are pushed on over protrusions 13 radially extending from a grip part 12 with a part-spherical surface so that despite an angle between banner cylinder and the grip part 12 the cylinder can easily be pushed on. The grip part 12 is concentrically arranged on a cog wheel 14 journaled in the end of the foot part.

The cog wheel 14 meshes with a further cog wheel 15 carrying a first conical cog wheel 6 that in turn meshes with a second conical cog wheel 16. Concentrically with the second cog wheel and integrated with this a drum 17 is arranged. The drum 17 is conical and is in its wider end provided with a helically shaped grove 18. In the wider end of the drum a rubber string 19 is furthermore fastened extending radially out through the conical part in the wider end of the drum. The rubber string extends from the drum away towards the other end of the foot part where it runs over a pulley 20 and back towards the first end, over a further pulley there and back to the other end where the string is fastened.

When the banner is drawn upwards the drum via the cog wheels is brought to rotate winding up the rubber string, to start with in the wider end of the spiral grove and then further down towards the thinner end of the drum.

When the banner is made free in the upper end and lowered downwards the rubber spring causes an up-winding turning of the banner cylinder. When successively the rubber spring is wound off from the drum the tension in the spring lessons, but this is counteracted by the increasing diameter providing an increasing leaver for the rubber spring. This makes the retraction strong and safe even at the end of the rolling up of the banner.

Since the cog wheel transfer gears down the turning movement, that is the number of revolutions a shorter winding up of the rubber string than of the banner is obtained and thereby a flat spring characteristic. Since it is a rubber string due to its hysteresis also a softer up-rolling is obtained as compared with other spring devices. Since the rubber spring more or less extends from end to end the angular variation at off- and up-winding becomes small and the turns of the string land side by side at each winding up, in turn securing a good and unchanging function.

The string is mounted with a certain pretension, which means that the rubber string exert a turning force on the drum until the string points straight towards the other end out from the drum. Since the rubber string furthermore tends to become straight the drum is turned and thereby also the banner cylinder to the same starting position. No turning need thus to be executed when a new banner cylinder is pushed on but one can quite simply settle for a pushing on of the new cylinder.

The cylinder is in the other end of the foot part held in place by putting a pin extending from the end of the cylinder into an upwards open seat formed on the end wall and that a slide is pushed in over the axle pin in order to prevent movement upwards of the axle pin and thereby the cylinder. When the cylinder is to be exchanged or removed to be provided with a new banner the slide is pulled away and the cylinder is in the axle pin end pivoted up and the cylinder is axially drawn out from the mounting on the cog wheel.

A lid covering the receiving space for the banner roll is journalled in the ends. The lid forms together with the foot part a slot at the edge between lid and foot part so that the banner may extend up through this. When mounting the banner stand nothing more than a pulling up of the banner and a mounting of the pole is needed. In other words the stand is easy and simple to handle at mounting as well as at change of banners. The parts are further simple and robust securing a reliable function.

Within the concept of the invention one can further consider the foot part on its inside or outside, for instance on the bottom side being provided with holders for holding of a pole for the holding of the upper end of the banners, which pole is separated into parts.

Instead of using a conical roller for the winding of the rubber string one can consider the revolutions of the rubber string being wound on each other in order to provide varying diameter and up-winding torque.

The invention claimed is:

1. A stand for a banner, including a foot part that takes up a cylinder on which the banner can be rolled up and drawn out from respectively; and a device to achieve a rolling up movement for rolling up the banner, wherein a winding up device includes a drive device coupled to the cylinder for rolling up of the banner, which drive device includes a rubber string, the rubber string, when drawing out the banner, is wound up on a drum that is conical and with the rubber string fastened in a wider end of the drum so that, when the banner is rolled up, the rubber string runs out from the wider end of the conical drum so that a torque that is achieved by the rubber string is sufficient for completely rolling up the banner despite the rubber string in this position having its minimum tension force.

2. The stand according to claim 1, wherein a force and a movement transfer between the drum and the cylinder is by means of cog wheels.

3. The stand according to claim 1, wherein the drum is arranged cross-wise in relation to the cylinder and that the rubber string is arranged in a length direction of the cylinder.

4. The stand according to claim 1, wherein the wider end of the drum is formed with a spiral shaped profiling for reception and control of the rubber string in the wider end of the drum.

5. The stand according to claim 1, wherein the rubber string via one or several pulleys is led forwards and backwards so that a length of the rubber string is increased.

6. The stand according to claim 1, wherein the cylinder on an inside is provided with axial grooves and a gripping part in the drive device includes corresponding grip parts.

7. The stand according to claim 6, wherein each of the gripping parts is part-spherical in order to allow pushing on of the cylinder even with a certain relative angle.

8. The stand according to claim 1, wherein the rubber string is fastened in such a way to the drum that it extends radially out from the drum at a fastening point.

9. The stand according to claim 1, wherein a turning movement from the banner cylinder to the drum of the rubber string is geared such that a number of revolutions to wind up the rubber string is smaller than a number of revolutions to wind up the banner.

* * * * *